US007971443B2

(12) United States Patent
Nishita et al.

(10) Patent No.: US 7,971,443 B2
(45) Date of Patent: Jul. 5, 2011

(54) REFRIGERATOR

(75) Inventors: Masayasu Nishita, Matsubara (JP); Yoshinari Fujihara, Osaka (JP); Yasuji Ohshiro, Izumiotsu (JP); Kayo Takashima, Kobe (JP)

(73) Assignee: Sharp Kabushiki Kaisha, Osaka (JP)

( * ) Notice: Subject to any disclaimer, the term of this patent is extended or adjusted under 35 U.S.C. 154(b) by 1079 days.

(21) Appl. No.: 11/666,247

(22) PCT Filed: Sep. 7, 2005

(86) PCT No.: PCT/JP2005/016387

§ 371 (c)(1),
(2), (4) Date: Apr. 25, 2007

(87) PCT Pub. No.: WO2006/046355

PCT Pub. Date: May 4, 2006

(65) Prior Publication Data

US 2009/0193826 A1 Aug. 6, 2009

(30) Foreign Application Priority Data

Oct. 28, 2004 (JP) ..... 2004-313218
Nov. 18, 2004 (JP) ..... 2004-333860
Nov. 24, 2004 (JP) ..... 2004-338757

(51) Int. Cl.
*F25B 29/00* (2006.01)
*F25D 11/00* (2006.01)
*F25D 11/02* (2006.01)

(52) U.S. Cl. ..... 62/159; 62/441; 62/440

(58) Field of Classification Search ..... 62/159, 62/441, 455, 440
See application file for complete search history.

(56) References Cited

U.S. PATENT DOCUMENTS 6,497,113 B1 * 12/2002 Yamada et al. ..... 62/441

FOREIGN PATENT DOCUMENTS

| | | | | |
|---|---|---|---|---|
| CH | 681107 | A5 | | 1/1993 |
| EP | 0 053 589 | A2 | | 11/1981 |
| FR | 2 631 690 | A3 | | 11/1989 |
| JP | 63-201472 | A | | 8/1988 |
| JP | 3-34583 | U | | 4/1991 |
| JP | 04-225753 | A | | 8/1992 |
| JP | 05-149659 | A | | 6/1993 |
| JP | 05-187756 | A | | 7/1993 |
| JP | 05-187762 | A | | 7/1993 |
| JP | 06-011229 | A | | 1/1994 |
| JP | 07-055319 | A | | 3/1995 |
| JP | 10148464 | A | * | 6/1998 |
| JP | 10-288440 | A | | 10/1998 |
| JP | 10300311 | A | * | 11/1998 |
| JP | 2000-161683 | A | | 6/2000 |
| JP | 2000220933 | A | * | 8/2000 |
| JP | 2003-056978 | A | | 2/2003 |
| JP | 2004-227382 | A | | 8/2004 |
| SU | 234431 | | | 5/1969 |
| SU | 1307183 | A1 | | 4/1987 |

* cited by examiner

*Primary Examiner* — Chen-Wen Jiang
(74) *Attorney, Agent, or Firm* — Birch, Stewart, Kolasch & Birch, LLP

(57) ABSTRACT

There is provided a temperature switching compartment 3 which can switch the internal temperature thereof between a low temperature side at which a storage material is kept in cold storage and a high temperature side maintained at 50° C., to 80° C. at which cooked food is kept warm, by cooling with a cooler 17 and heating with a heater 15.

8 Claims, 12 Drawing Sheets

REFRIGERATOR

TECHNICAL FIELD

The present invention relates to a refrigerator including a temperature switching compartment that allows the user to switch the internal temperature thereof to a desired temperature.

BACKGROUND ART

Recently with remarkable changes in living environment, the number of families in which individuals take meals at different times has been increasing. Accordingly, insulating boxes and insulating storage containers are used to keep the cooked food warm, thereby avoiding the trouble of having to perform cooking many times.

On the other hand, a refrigerator provided with a temperature switching compartment in addition to a freezer compartment and refrigeration compartment is disclosed in Patent Document 1. This refrigerator includes a damper for opening/closing a passage for cold air to be delivered to the temperature switching compartment and a heater for increasing the temperature of the temperature switching compartment, thereby permitting the internal temperature of the temperature switching compartment to be switched to a desired low temperature range, such for freezing, refrigeration, partial, and chilled, in response to a user's usage.

Patent Document 1: JP-A-H10-288440

DISCLOSURE OF THE INVENTION

Problems to be Solved by the Invention

However, if an insulating box or a storage container is used for keeping cooked food warm, it is difficult to secure a space therefor, and a financial burden on the user is increased. Furthermore, such a box or container is inconvenient because transferring food thereto requires much time and trouble.

An object of the present invention is to provide a highly convenient refrigerator by decreasing a financial burden and making it easy to secure a space.

Means for Solving the Problem

To attain the aforementioned object, the present invention provides a refrigerator having at least one storage compartment for keeping storage material in cold storage, which includes a temperature switching compartment that can switch the internal temperature thereof, by cooling with a cooler and by heating with a heater, to a low temperature side at which the storage material is kept in cold storage and to a high temperature side at which cooked food is kept warm.

According to this configuration, when a temperature switching compartment is switched to a low temperature side, cold air is introduced from a cooler, and therefore, the temperature switching compartment becomes a low temperature compartment, such for freezing, partial, chilled, and refrigeration. This allows the storage material to be kept in refrigerated or cold storage. When the temperature switching compartment is switched to a high temperature side, a heater is driven to increase the temperature of the temperature switching compartment. This makes it possible to perform temporary heat insulation of cooked food, cooking performed in winter by keeping the temperature high without use of heat, and the like.

Further, in the above-configured refrigerator of the present invention, the temperature switching compartment sets a temperature on the high temperature side at 50° C. to 80° C.

Further, in the above-configured refrigerator of the present invention, the heater is made up of a thermal radiation type heater.

Further, in the above-configured refrigerator of the present invention, there are included a first introducing ventilation passage for introducing cold air generated by the cooler to the temperature switching compartment, a first ventilation return passage for introducing air in the temperature switching compartment to the cooler, a temperature switching compartment discharge damper for adjusting air volume flowing into the temperature switching compartment from the first introducing ventilation passage, and a temperature switching compartment return damper for adjusting air volume flowing out to the first ventilation return passage from the temperature switching compartment.

According to this configuration, when the temperature switching compartment is cooled, the temperature switching compartment discharge damper and the temperature switching compartment return damper are opened. This causes the cold air to circulate between the temperature switching compartment and the cooler via the first introducing ventilation passage and the first ventilation return passage. When the temperature switching compartment is cooled to a set temperature, the temperature switching compartment discharge damper is closed to prevent overcooling. At this time, the temperature switching compartment return damper does not have to be closed, but it is preferable to close it for preventing cold air from flowing out therethrough. When the temperature is increased to keep the temperature of the temperature switching compartment, the temperature switching compartment discharge damper and the temperature switching compartment return damper are closed, and the heater is driven. This prevents the air inside the temperature switching compartment from flowing out thereof, and accordingly the temperature switching compartment is kept at a high temperature. Once the temperature of the temperature switching compartment increases to the set temperature, the heater stops.

Further, in the above-configured refrigerator of the present invention, there is included a temperature switching compartment blower for stirring air inside the temperature switching compartment, provided in the first introducing ventilation passage or inside the temperature switching compartment. According to this configuration, the air is circulated in the temperature switching compartment on the high temperature side by the driving of the temperature switching compartment blower.

Further, in the above-configured refrigerator of the present invention, the storage compartment includes a freezer compartment for keeping the storage material in frozen storage. Here, there are provided a second return ventilation passage for introducing air in the freezer compartment to the cooler, and a freezer compartment damper for adjusting air volume flowing into a second return ventilation passage from the freezer compartment. According to this configuration, for example, the freezer compartment closes when the temperature switching compartment is switched from the high temperature side to the low temperature side, and the exhaust air of the temperature switching compartment is prevented from flowing into the freezer compartment.

Further, in the above-configured refrigerator of the present invention, the storage compartment is made up of a refrigeration compartment for keeping the storage material in refrigerated storage. Here, there are provided a chilled compartment disposed in the refrigeration compartment, a second introducing ventilation passage for introducing cold air generated in the cooler to the chilled compartment, and a chilled compartment damper for adjusting air volume flowing into the chilled compartment from the second introducing ventilation passage. According to this configuration, for example, when the chilled compartment reaches the set temperature, the chilled compartment damper closes. In this way, overcooling is prevented.

Further, in the above-configured refrigerator of the present invention, a refrigerant used in a freezing cycle for cooling said cooler is a flammable refrigerant, and the heater has a surface temperature which is lower than an ignition point of said flammable refrigerant.

Further, in the above-configured refrigerator of the present invention, there is included a metal plate disposed on the circumference of said heater.

Further, in the above-configured refrigerator of the present invention, the heater is disposed on a bottom part of the temperature switching compartment, with an interspace provided between the heater and a bottom surface of said temperature switching compartment; and the metal plate is disposed to the side of the heater opposite from the bottom surface of the temperature switching compartment.

Further, in the above-configured refrigerator of the present invention, there is included a storage case having a bottom surface made of metal, which is disposed in the temperature switching compartment.

Further, in the above-configured refrigerator of the present invention, a clearance of 7 mm or smaller is provided between the storage case and the side surface or the bottom surface of the temperature switching compartment.

Further, in the above-configured refrigerator of the present invention, there is included a detector which detects whether the storage case is disposed in the temperature switching compartment, wherein the heater is controlled based on the detected results of the detector. According to this configuration, for example, when the storage case is removed for cleaning or the like and when it is detected that the storage case is not placed in position, energization of the heater stops. This decreases the temperature of the metal plate, and accordingly reduces the risk of the user having a burn injury by accidentally touching the metal plate.

Further, in the above-configured refrigerator of the present invention, there is included a metal shelf in the temperature switching compartment.

Further, in the above-configured refrigerator of the present invention, a capacity of the heater in a period during which temperature increases from the low temperature side to the high temperature side is larger than a capacity of the heater in a period during which temperature is kept at the high temperature side. According to this configuration, when the temperature switching compartment is switched to the high temperature side, the heater is driven by a large capacity, and the temperature switching compartment enters an increasing temperature period during which the temperature thereof is increased to a high temperature. When the temperature switching compartment reaches a predetermined temperature, the heater is driven by a small capacity, and it enters a heat insulation period during which the temperature is kept constant at a high temperature.

Further, in the above-configured refrigerator of the present invention, the capacity of the heater is changed by the duty factor of the heater. According to this configuration, when the temperature switching compartment is switched to the high temperature side, the heater is driven at a duty factor of 100%, for example. When the temperature switching compartment becomes a predetermined temperature, the heater is driven, for example, at a duty factor of 50% to keep the temperature constant at a high temperature.

Further, in the above-configured refrigerator of the present invention, there are included a first detector for detecting the internal temperature of the temperature switching compartment and a second detector provided next to the heater for detecting the temperature in the neighborhood of the heater, wherein the capacity of the heater is changed based on the detection result of the first detector; and the heater stops when the detection temperature of the second detector is larger than a predetermined temperature.

According to this configuration, the internal temperature of the temperature switching compartment in the increasing temperature period is detected with the first detector. When the detection temperature of the first detector reaches a predetermined temperature, the heater capacity is lowered to be a heat insulation state. When the detection temperature of the second detector becomes higher than a predetermined temperature during the increasing temperature period or during the heat insulation period, the heater stops.

Further, in the above-configured refrigerator of the present invention, there is included a blower for circulating air in the temperature switching compartment, wherein the blower starts to be driven a predetermined time before the heater is energized, and is stopped being driven a predetermined time after the heater is stopped. According to this configuration, the heater is energized to increase the temperature in a state where circulating airflow is generated in the temperature switching compartment by driving the blower. Further, the stopped heater is cooled by the airflow produced by the blower.

Further, in the above-configured refrigerator of the present invention, there are included a first detector for detecting the internal temperature of the temperature switching compartment and a blower for circulating air in the temperature switching compartment, wherein the capacity of the heater is changed based on the detection result of the first detector; and the air volume of the blower increases when the detection temperature of the first detector exceeds a predetermined temperature.

According to this configuration, the internal temperature of the temperature switching compartment is detected with the first detector, and, when the detection temperature of the first detector reaches the set temperature by increasing the temperature of the temperature switching compartment, the heater capacity is lowered, so that the temperature switching compartment becomes a heat insulation state. Further, when the detection temperature of the first detector reaches a predetermined temperature, the air volume is increased, so that cooling effect is accelerated. The predetermined temperature is set to a temperature that is lower than a temperature at which the heater stops and an alarm is performed due to an abnormally high temperature.

Further, in the above-configured refrigerator of the present invention, there is included a second detector provided next to the heater for detecting the temperature in the neighborhood of the heater, wherein the air volume of the blower increases when the detection temperature of the second detector exceeds a predetermined temperature. According to this configuration, when the detection temperature of the second detector reaches a predetermined temperature, the air volume is increased, so that cooling effect is accelerated.

Further, in the above-configured refrigerator of the present invention, there are included a first detector for detecting the internal temperature of the temperature switching compartment, a second detector provided next to the heater for detecting the temperature in the neighborhood of the heater, and a blower for circulating air in the temperature switching compartment, wherein the capacity of the heater is changed based on the detection result of the first detector; and the air volume of the blower increases when a difference between the detection temperatures of the first and second detector exceeds a predetermined temperature.

According to this configuration, the internal temperature of the temperature switching compartment is detected with the first detector, and, when the detection temperature of the first detector reaches the set temperature by increasing the temperature in the temperature switching compartment, the heater capacity is lowered, so that the temperature switching compartment becomes a heat insulation state. Further, when a difference between the detection temperatures of the first and the second detector reaches a predetermined temperature, the air volume is increased, so that cooling effect is accelerated. The predetermined temperature is set to a temperature difference that is smaller than a temperature difference at which the heater stops, for example, due to an abnormally high temperature in the neighborhood of the heater.

Further, in the above-configured refrigerator of the present invention, there is included an open/close detector for detecting the opening and closing of a door of the temperature switching compartment, wherein the heater stops when the door of the temperature switching compartment opens in the period during which temperature increases or the period during which temperature is kept at the high temperature side; and the heater is energized when the door closes. According to this configuration, when the door of the temperature switching compartment in the increasing temperature period or in the heat insulation period during which the temperature is kept at a high temperature opens, the open/close detector detects it and stops the heater.

Further, in the above-configured refrigerator of the present invention, there are included an open/close detector for detecting the opening and closing of a door of the temperature switching compartment and a blower for introducing cold air into the temperature switching compartment, wherein the blower is driven in a period during which the temperature of the temperature switching compartment is decreased from the high temperature side to the low temperature side; and the blower is kept driven when the door opens.

Further, in the above-configured refrigerator of the present invention, there is included a freezer compartment for keeping the storage material in frozen storage by cooling with the cooler, wherein, in a period during which the temperature of the temperature switching compartment is decreased from the high temperature side to the low temperature side, air flowing out from the freezer compartment and the temperature switching compartment is introduced to the cooler; cooled air is delivered by being divided into the freezer compartment and the temperature switching compartment; and the set temperature of the freezer compartment is lowered to produce an overcooled state.

According to this configuration, when the temperature switching compartment is switched from the high temperature side to the low temperature side, the freezer compartment is made to communicate with the temperature switching compartment by the opening of the damper, for example. Air in the freezer compartment and the temperature switching compartment is introduced to the cooler, and air cooled by the cooler flows so as to be divided into the freezer compartment and the temperature switching compartment. Since the temperature of the air flowing out from the temperature switching compartment is high, and is not lowered to a predetermined low temperature, the freezer compartment is cooled to a temperature that is lower than a regular set temperature.

ADVANTAGES OF THE INVENTION

According to the present invention, since there is provided the temperature switching compartment capable of switching the internal temperature thereof between the low temperature side at which the storage material is kept in cold storage and the high temperature side at which cooked food is kept warm, a highly convenient refrigerator can be provided by decreasing a financial burden and making it easy to secure a space for keeping cooked food warm.

Further, according to the present invention, since the temperature switching compartment sets a temperature on the high temperature side at 50° C. to 80° C., it is possible to keep warm at a temperature higher than a growth temperature of most food poisoning bacteria and to provide a refrigerator which is safe in food sanitation. Furthermore, since the temperature on the high temperature side is kept at a temperature that is lower than a heat resistant temperature of commonly used resin parts, it is possible to realize a refrigerator having the temperature switching compartment at a low price.

Further, according to the present invention, since the heater is made up of a glass tube heater of a thermal radiation type, the heating speed is fast. This permits the temperature to quickly exceed the growth temperature range of food poisoning bacteria. Therefore, a refrigerator that is safe in food sanitation can be provided. Furthermore, since the space occupied by the heater is small even when the capacity thereof is increased, the risk of the user having a burn injury is reduced by disposing the heater at a back part of the temperature switching compartment.

Further, according to the present invention, since the temperature switching compartment discharge damper and the temperature switching compartment return damper are provided, sealing property of the temperature switching compartment is improved. This permits the temperature switching compartment to keep a high temperature thereof for longer time. In addition to this, heated air can be prevented from flowing back into other compartments.

Further, according to the present invention, since the temperature switching compartment blower is provided, temperature switching of the temperature switching compartment can be performed quickly. Furthermore, the internal temperature can be kept uniform by circulating the air in the temperature switching compartment. Further, by directing air to the surface of the heater, it is possible to prevent an increase in a surface temperature of the heater.

Further, according to the present invention, since the freezer compartment damper is provided, when the temperature switching compartment is switched from the high temperature side to the low temperature side, exhaust air from the temperature switching compartment does not flow back into the freezer compartment. This makes it possible to prevent an increase in the temperature of the freezer compartment.

Further, according to the present invention, since the chilled compartment damper is provided, overcooling in the chilled compartment can be prevented.

Further, according to the present invention, since a surface temperature of the heater is lower than the ignition point of the flammable refrigerant, it is possible to prevent ignition from occurring when the refrigerant leaks, and therefore, a safe refrigerator can be provided.

Further, according to the present invention, since the metal plate is disposed around the heater, the heat from the heater is transmitted to the metal plate and released into the temperature switching compartment extensively, and therefore the heating efficiency can be improved.

Further, according to the present invention, the heater is disposed on a bottom part of the temperature switching compartment, with an interspace provided between the heater and a bottom surface of the temperature switching compartment, and the metal plate is disposed to the side of the heater opposite from the bottom surface of the temperature switching compartment. As a result, the heater is covered with the metal plate, and accordingly it becomes possible to avoid the risk of the user having a burn injury by touching the heater. Furthermore, since the interspace is disposed on the lower side of the heater, the heater and the inner wall of the temperature switching compartment are thermally insulated by air, thus a rise in the temperature of the inner wall is suppressed. This prevents the inner wall from being deformed, and the influence of heat on the storage compartment on the other side of the inner wall can be suppressed.

Further, according to the present invention, since the storage case having the bottom surface made of metal is disposed in the temperature switching compartment, heating from the bottom surface of the storage case can be effectively performed by the heater disposed on the lower side of the storage case. Furthermore, the bottom surface of the storage case can be prevented from being deformed by the weight of food accommodated in the storage case during heating by the heater. Further, even if a cooking utensil (a frying pan, a pan, or the like) just removed from the heat is placed directly on the storage case, thermal deformation thereof can be prevented.

Further, according to the present invention, the clearance of 7 mm or less is provided between the storage case and the side surface or the bottom surface of the temperature switching compartment. This makes it difficult for the user to touch the metal plate, and accordingly improves the safety of a refrigerator 1.

Further, according to the present invention, since the heater is controlled based on the detected results of the detector which detects whether the storage case is placed in the temperature switching compartment, when the storage case 11 is removed for cleaning or the like, it becomes possible to reduce the risk of the user having a burn injury by accidentally touching the metal plate.

Further, according to the present invention, since the metal shelf is provided in the temperature switching compartment, the food storage efficiency is improved, and, when food is placed in the temperature switching compartment in a high temperature state, deformation due to the weight of food can be prevented. Furthermore, as a result of the metal shelf having a net structure, the air inside the temperature switching compartment produces convection with ease, making it possible to keep the internal temperature uniform.

According to the present invention, since a capacity of the heater in a period during which temperature increases from the low temperature side to the high temperature side is larger than a capacity of the heater in a period during which temperature is kept at the high temperature side, the temperature switching compartment can be rapidly switched to the high temperature side.

Further, according to the present invention, since the capacity of the heater is changed by the duty factor of the heater, it is possible to realize a refrigerator that can change the heater capacity with ease.

Further, according to the present invention, there are included a first detector for detecting the internal temperature of the temperature switching compartment and a second detector provided next to the heater for detecting the temperature in the neighborhood of the heater, wherein the heater stops by the detection of the second detector. This makes it possible to prevent overheating in a part adjacent to the heater, which cannot be detected by the first detector, and to prevent smoking, ignition, deformation, or the like, of the heater and around the heater. Therefore, even when a large capacity heater is used, a refrigerator with a high level of safety can be realized.

Further, according to the present invention, since the blower starts to be driven a predetermined time before the heater is energized, the heater is energized in a state where circulating airflow is generated in the temperature switching compartment. This helps prevent overheating around the heater. Furthermore, since the blower is stopped being driven a predetermined time after the heater is stopped, the heater is cooled by the airflow produced by the blower. This helps prevent overheating around the heater. Therefore, the safety can be further improved.

Further, according to the present invention, there are included a first detector for detecting the internal temperature of the temperature switching compartment and a blower for circulating air in the temperature switching compartment, wherein the air volume of the blower increases when the detection temperature of the first detector exceeds a predetermined temperature. As a result, cooling is performed by increasing the air volume before the inside of the temperature switching compartment becomes an abnormally high temperature, thus overheating can be prevented. This makes it possible to further improve the safety, and to improve the convenience by reducing the occurrence of abnormal stop or the like.

Further, according to the present invention, since the air volume of the blower increases when the detection temperature of the second detector provided next to the heater for detecting the temperature in the neighborhood of the heater exceeds a predetermined temperature, cooling is performed by increasing the air volume before the temperature around the heater becomes abnormally high. Thus, overheating can be prevented.

Further, according to the present invention, since there are included a first detector for detecting the internal temperature of the temperature switching compartment, a second detector provided next to the heater for detecting the temperature in the neighborhood of the heater, and a blower for circulating air in the temperature switching compartment, wherein the air volume of the blower increases when a difference between the detection temperatures of the first and second detector exceeds a predetermined temperature, it is possible to make uniform the temperature distribution inside the temperature switching compartment. Therefore, it is possible to prevent a part adjacent to the heater from becoming an abnormally high temperature due to the blockage or the like caused by the storage material.

Further, according to the present invention, since the heater stops when the door of the temperature switching compartment on the high temperature side opens, and the heater is energized when the door closes, burn injury from contact with the heater at high temperature can be prevented. Thus the safety can be further improved.

Further, according to the present invention, since the blower is driven in a period during which the temperature of the temperature switching compartment is decreased from the high temperature side to the low temperature side and the blower is kept driven when the door opens, the temperature switching compartment can be rapidly switched to a low temperature by exhausting the high temperature air to the outside.

Further, according to the present invention, since the set temperature of the freezer compartment is lowered to produce an overcooled state in a period during which the temperature of the temperature switching compartment is decreased from the high temperature side to the low temperature side, it is possible to prevent the temperature of the freezer compartment from becoming locally high due to the inflow of high temperature air, and to maintain freshness of the storage material.

LIST OF REFERENCE SYMBOLS

Figure 1:
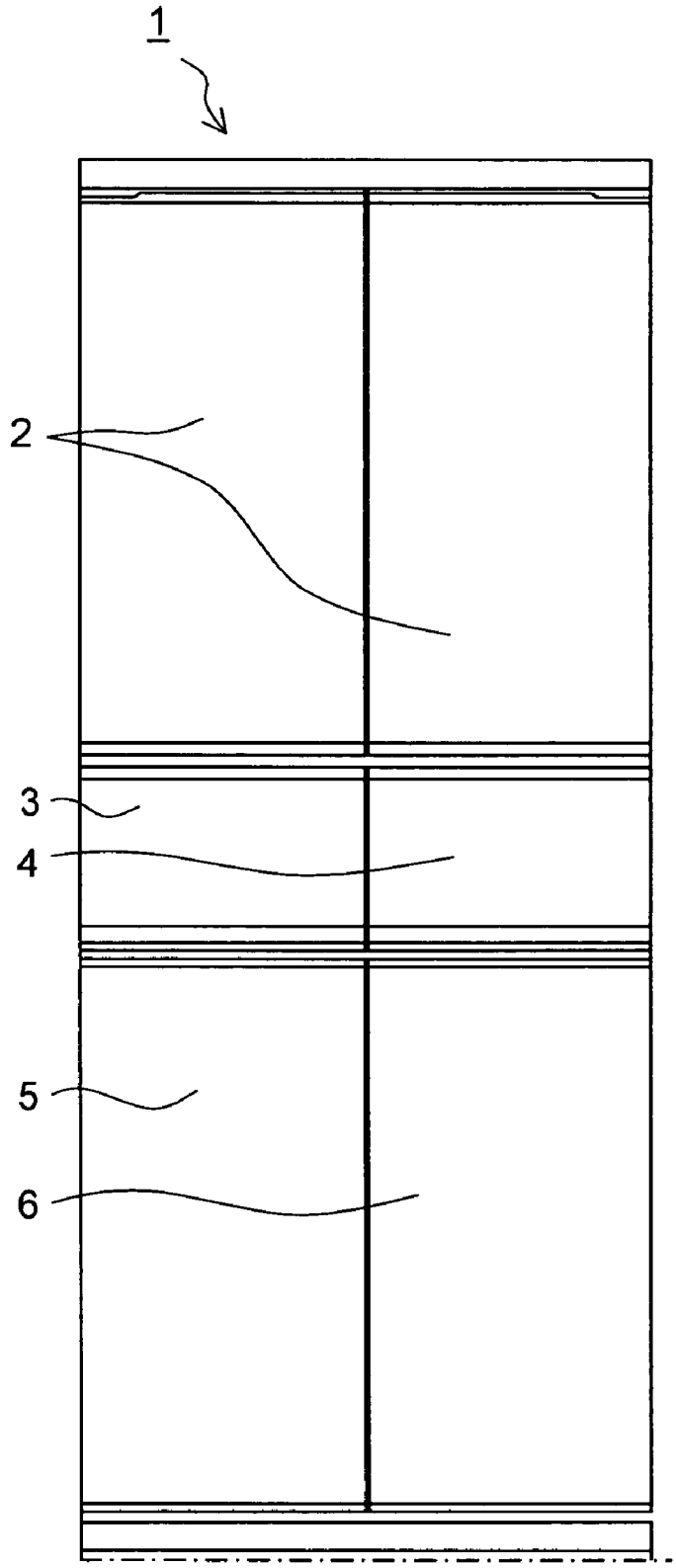
[FIG. 1] A front view showing a refrigerator according to a first embodiment of the present invention.

1 refrigerator
2 refrigeration compartment
3 temperature switching compartment
4 ice compartment
5 vegetables compartment
6 freezer compartment
9 door
12, 26 introducing ventilation passage
13 temperature switching compartment discharge damper
14, 18, 28 blower
15 heater
17 cooler
16, 24 temperature sensor
19, 21 ventilation return passage
20 temperature switching compartment return damper
22 freezer compartment damper
25 chilled compartment damper
30 thermal fuse
31, 32 cold air passage
33 rear plate
35 compressor
40 metal plate
43 net shelf
45 magnet
46 reed switch
51 interspace

BEST MODE FOR CARRYING OUT THE INVENTION

Figure 2:
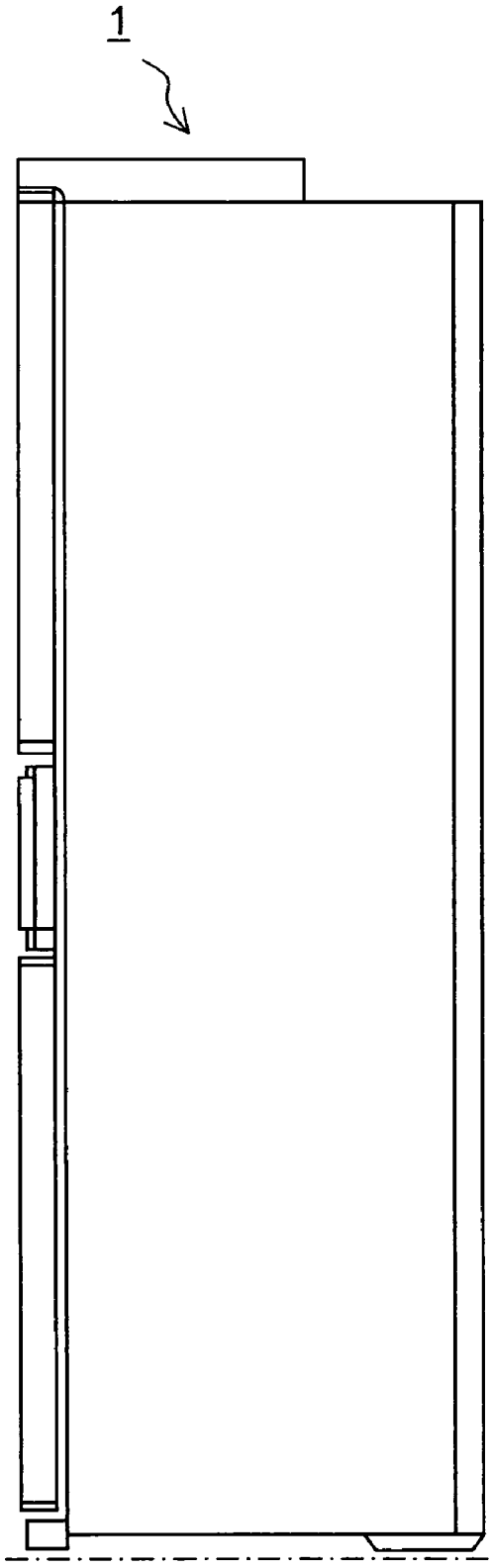
[FIG. 2] A right side view showing the refrigerator according to the first embodiment of the present invention.

An embodiment of the present invention will be described below with reference to the drawings. FIG. 1 and FIG. 2 are a front view and a right side view showing a refrigerator according to one embodiment. A refrigerator 1 includes a refrigeration compartment 2 disposed at the upper section; and a temperature switching compartment 3 and an ice compartment 4 disposed at the middle section. A vegetables compartment 5 and a freezer compartment 6 are disposed in the lower section of the refrigerator.

The refrigeration compartment 2 has hinged double doors and keeps a storage material in refrigerated storage. The temperature switching compartment 3 is provided on the left side of the middle section so that the internal temperature can be switched by the user. The ice compartment 4 is provided on the right side of the middle section and produces ice. The vegetables compartment 5 is disposed on the left side of the lower section and maintained at a temperature (approximately 8° C.) which is suitable for vegetable storage. The freezer compartment 6 is provided on the right side of the lower section and is made to communicate with the ice compartment 4 to keep the storage material in frozen storage.

Figure 3:
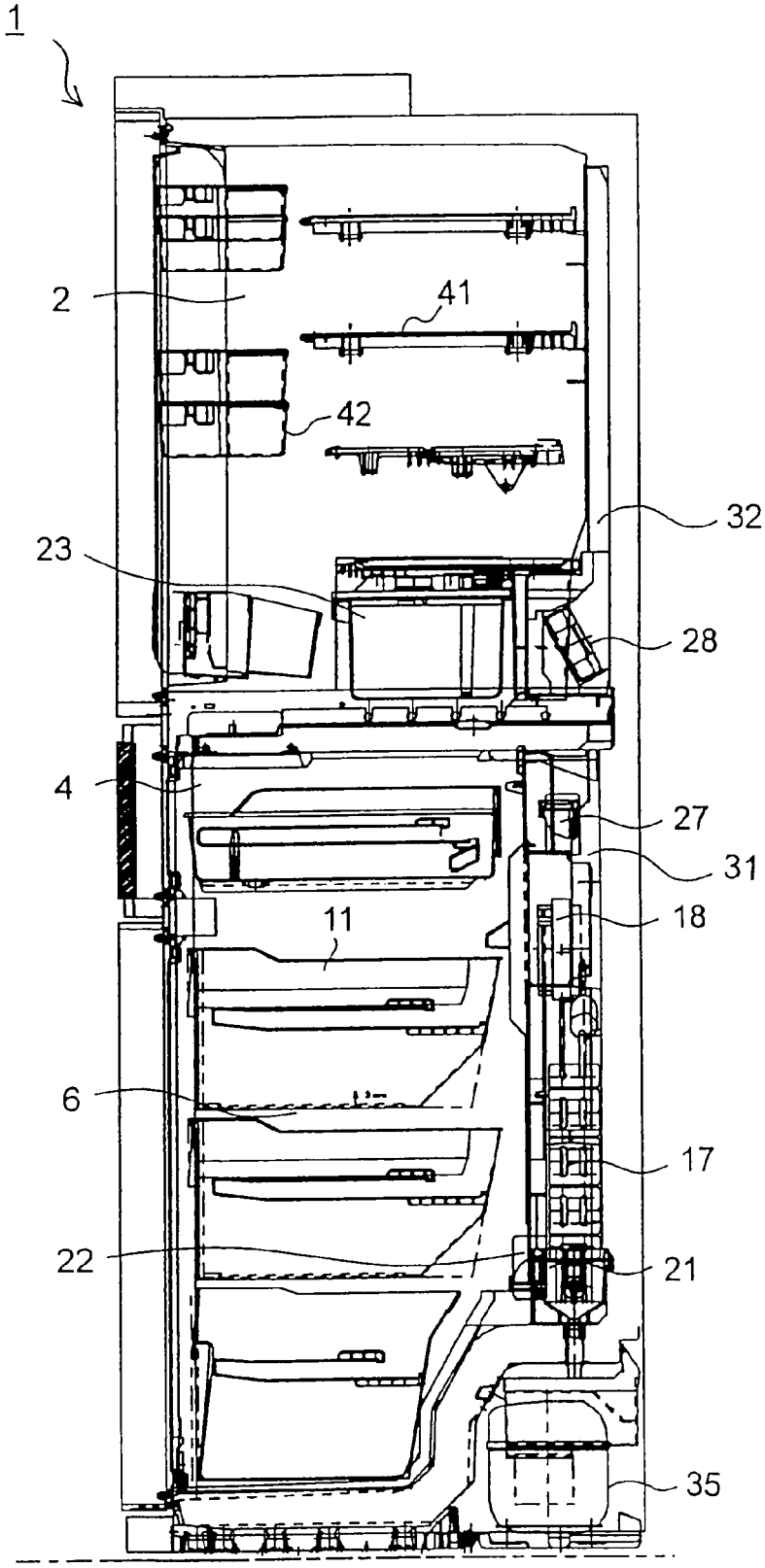
[FIG. 3] A right sectional side view showing the refrigerator according to the first embodiment of the present invention.

FIG. 3 is a right sectional side view of the refrigerator 1. Storage cases 11, which accommodate the storage material, are disposed in the freezer compartment 6 and the ice compartment 4. Similar storage cases 11 are also provided in the vegetables compartment 5 and the temperature switching compartment 3. A plurality of storage shelves 41, on which the storage material is placed, are provided in the refrigeration compartment 2. A storage pocket 42 is provided in a door of the refrigeration compartment 2. These improve the usability of the refrigerator 1. Further, a chilled compartment 23, which is maintained at a chilled temperature zone (approximately 0° C.), is provided inside the refrigeration compartment 2 in a lower part thereof.

A cold air passage 31 is provided at the back of the freezer compartment 6; and a cooler 17 connected to a compressor 35 is disposed in the cold air passage 31. A cold air passage 32 which is made to communicate with the cold air passage 31 is provided at the back of the refrigeration compartment 2. A refrigerant such as isobutane or the like is circulated by the driving of the compressor 35 to which a condenser and an expander (each of them are not shown) are connected, so that a freezing cycle is run. In this way, a cooling system is formed, and cold air is generated by heat exchange with the cooler 17 which is a low temperature side of the freezing cycle.

Further, blowers 18 and 28 are respectively disposed in the cold air passages 31 and 32. As to be described later in detail, the cold air generated by the cooler 17 is supplied to the freezer compartment 6, the ice compartment 4, the chilled compartment 23, and the temperature switching compartment 3 via the cold air passage 31 by the driving of the blower 18, and is also supplied to the refrigeration compartment 2 and the vegetables compartment 5 via the cold air passage 32 by the driving of the blower 28.

Figure 4:
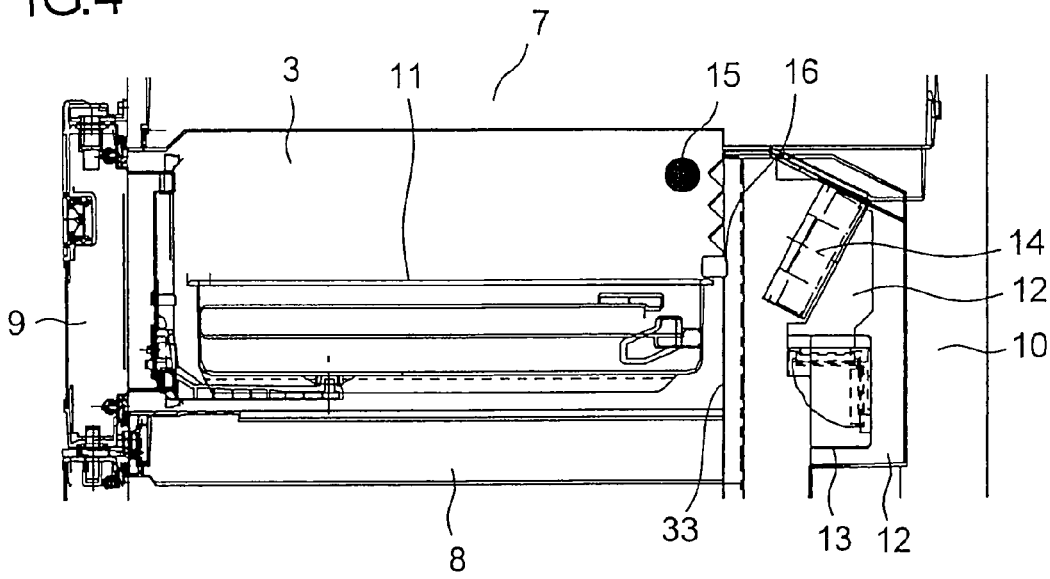
[FIG. 4] A right sectional side view showing a temperature switching compartment of the refrigerator according to the first embodiment of the present invention.

FIG. 4 is a right sectional side view showing the temperature switching compartment 3. The upper and lower surfaces of the temperature switching compartment 3 are partitioned into the refrigeration compartment 2 and the vegetables compartment 5 by partition walls 7 and 8. The front of the temperature switching compartment 3 is capable of opening/closing by a pivot type door 9. The back of the temperature switching compartment 3 is covered with a rear plate 33. The storage case 11 of a drawer type is disposed in the temperature switching compartment 3.

An introducing ventilation passage 12 (a first introducing ventilation passage) is provided at the rear of the rear plate 33 between the rear plate 33 and an insulated wall 10 which constitutes an outside wall. The introducing ventilation passage 12 is provided with a temperature switching compartment discharge damper 13 and communicated with the cold air passage 31 to introduce the cold air generated by the cooler 17 (see FIG. 3) to the temperature switching compartment 3. Further, the air volume flowing into the temperature switching compartment 3 from the introducing ventilation passage 12 is adjusted by the opening/closing of the temperature switching compartment discharge damper 13.

In the introducing ventilation passage 12, a blower 14 is provided between the temperature switching compartment discharge damper 13 and the rear plate 33. The cold air in the cold air passage 31 is easily introduced into the temperature switching compartment 3 by the driving of the blower 14. Further, an opening (not shown) which is made to communicate with the air intake side of the blower 14 is provided in the temperature switching compartment 3. This allows the air sealed in the temperature switching compartment 3 to circulate when the blower 14 is driven, and realizes efficient stirring. The blower 14 may be provided in the temperature switching compartment 3.

A heater 15 is provided at the upper rear of the temperature switching compartment 3. The heater 15 is made up of a glass tube heater of a thermal radiation type, and emits radiation heat to increase the temperature of the temperature switching compartment 3. Further, the blower 14 is so disposed as to send the air toward the surface of the heater 15. This lowers the surface temperature of the heater 15, and accordingly helps improve the safety.

A temperature sensor 16 is provided on the rear plate 33. The temperature sensor 16 detects the temperature inside the temperature switching compartment 3, and sends a detection signal to a control section (not shown). This makes the control section control the heater 15, the temperature switching compartment discharge damper 13, and the blower 14 based on the detection result of the temperature sensor 16 to maintain the temperature inside the temperature switching compartment 3 at a set temperature.

Figure 5:
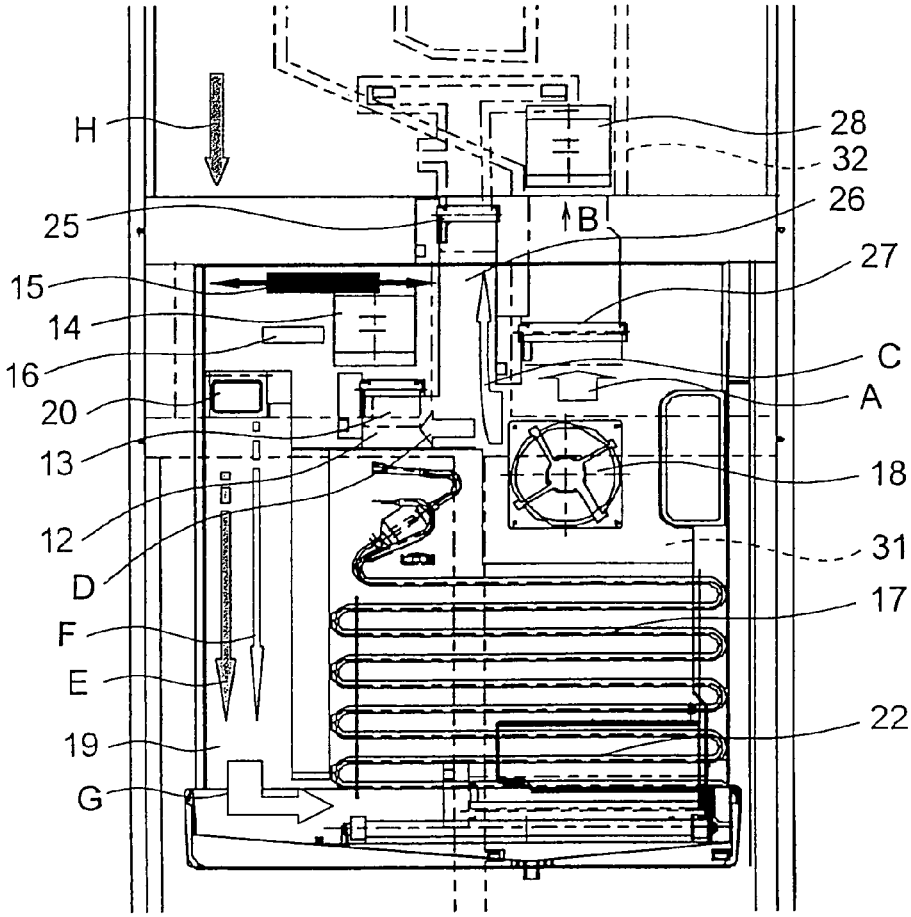
[FIG. 5] A front sectional view of a middle section of the refrigerator according to the first embodiment of the present invention.

FIG. 5 is a front sectional view of a middle section of the refrigerator 1. The cold air passage 31 provided at the rear of the freezer compartment 6 is opened at the upper front of the blower 18, and the air is delivered to the ice compartment 4 by the blower 18. A freezer compartment damper 22 is provided at the bottom part of the freezer compartment 6 which is made to communicate with the ice compartment 4. A ventilation return passage 21 (see FIG. 3), which introduces the air to the cooler 17 via the freezer compartment damper 22 and returns it to the cold air passage 31, is provided at the lower rear of the freezer compartment 6. The air volume flowing out from the freezer compartment 6 is controlled by the opening/closing of the freezer compartment damper 22.

The upper part of the cold air passage 31 is made to communicate with the cold air passage 32 via a refrigeration compartment damper 27. Further, the cold air passage 31 is divided and communicated with the introducing ventilation passage 12 (a first introducing ventilation passage) and an introducing ventilation passage 26 (a second introducing ventilation passage) as described above. The cold air is introduced to the chilled compartment 23 via a chilled compartment damper 25 disposed in the introducing ventilation passage 26.

A refrigeration compartment outflow opening (not shown) is opened at the lower rear of the refrigeration compartment 2, and a vegetables compartment inflow opening (not shown) is provided in the vegetables compartment 5. The refrigeration compartment outflow opening and the vegetables compartment inflow opening are coupled by a passage (not shown) passing along the rear of the temperature switching compartment 3, so that the refrigeration compartment 2 and the vegetables compartment 5 are communicated with each other.

A temperature switching compartment return damper 20 is provided at the lower left of the temperature switching compartment 3. A ventilation return passage 19, which extends downward from the temperature switching compartment return damper 20 to communicate with a ventilation return passage 21 (see FIG. 3), is provided at the rear of the temperature switching compartment 3 and the vegetables compartment 5. The air in the temperature switching compartment 3 is introduced to the cooler 17 via the ventilation return passages 19 and 21 as shown by the arrow marked F by opening the temperature switching compartment return damper 20. Further, the air volume flown out from the temperature switching compartment 3 is controlled by the opening/closing of the temperature switching compartment return damper 20. In addition, a vegetables compartment outflow opening (not shown) which is made to communicate with the ventilation return passage 19 is provided at the rear of the vegetables compartment 5.

Figure 6:
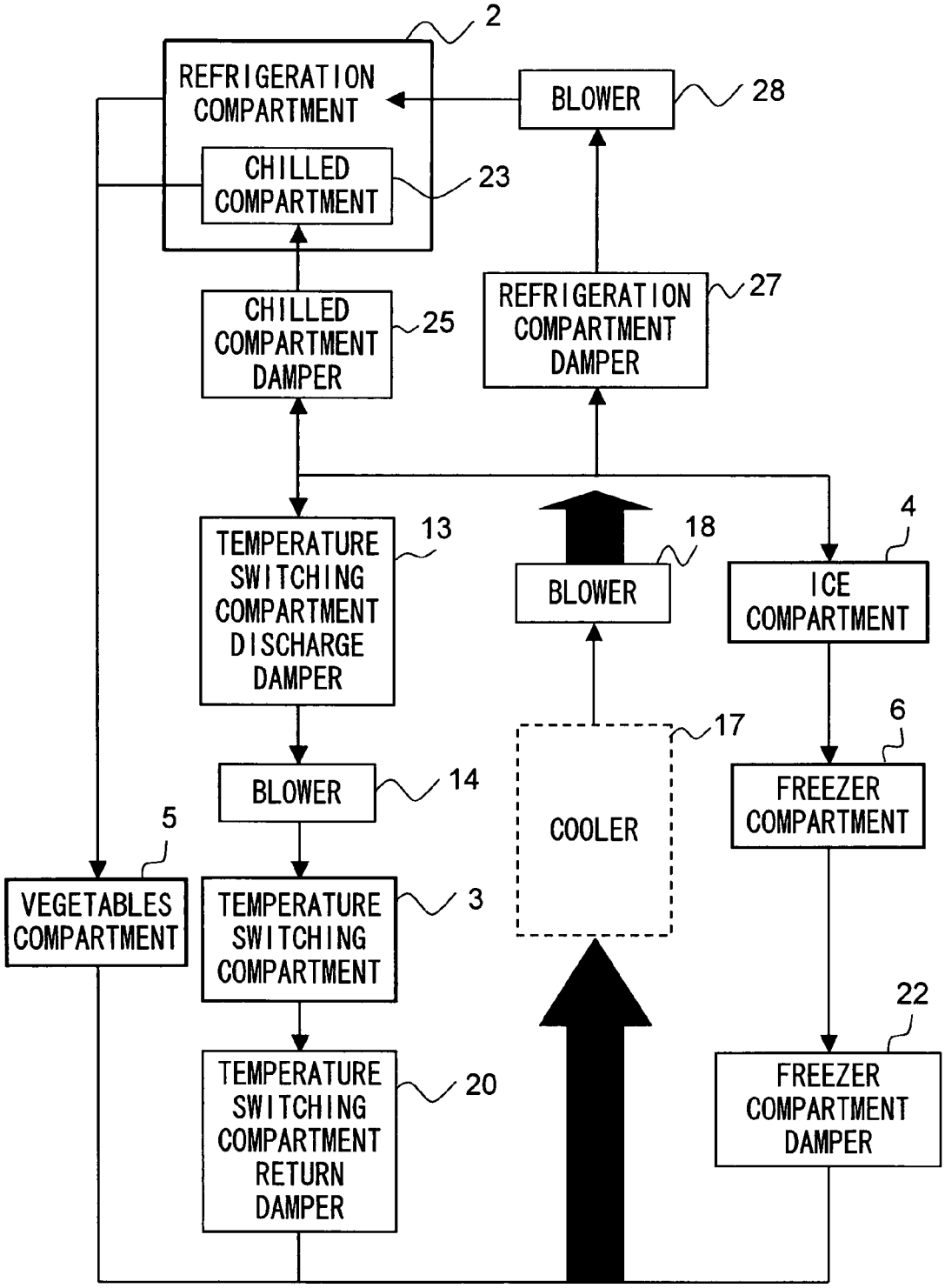
[FIG. 6] A cold air circuit diagram showing a cold air flow of the refrigerator according to the first embodiment of the present invention.

FIG. 6 is a cold air circuit diagram showing a cold air flow of the refrigerator 1. The cold air generated by the cooler 17 goes up through the cold air passage 31 as shown by the arrow marked A (see FIG. 5) by the driving of the blower 18, and is then delivered to the ice compartment 4. The cold air delivered to the ice compartment 4 flows through the ice compartment 4 and the freezer compartment 6, then flows out from the freezer compartment damper 22, and returns to the cooler 17 via the ventilation return passage 21 (a second ventilation return passage; see FIG. 3). In this way, the inside of the ice compartment 4 and the freezer compartment 6 is cooled.

By the driving of the blower 28, the cold air divided at the upper part of the cold air passage 31 passes through the cold air passage 32 as shown by the arrow marked B (see FIG. 5) via the refrigeration compartment damper 27, and is then delivered to the refrigeration compartment 2 and also to the chilled compartment 23 as shown by the arrow marked C (see FIG. 5). The resultant cold air passes through the refrigeration compartment 2 and the chilled compartment 23, and is then flown into the vegetables compartment 5 as shown by the arrow marked H (see FIG. 5).

The cold air flown into the vegetables compartment 5 passes through the vegetables compartment 5, and then returns to the cooler 17 via the introducing ventilation passage 19 as shown by the arrows marked E and G (see FIG. 5). In this way, the inside of the refrigeration compartment 2 and the vegetables compartment 5 is cooled. When the refrigeration compartment 2 and the vegetables compartment 5 reach the set temperature, the refrigeration compartment damper 27 and the chilled compartment damper 23 are closed.

Further, by the driving of the blower 14, the cold air divided at the upper part of the cold air passage 31 passes through the introducing ventilation passage 12, and is then flown into the temperature switching compartment 3 via the temperature switching compartment discharge damper 13 as shown by the arrow marked D (see FIG. 5). The cold air flown into the temperature switching compartment 3 passes through the temperature switching compartment 3, and is then flown out from the temperature switching compartment return damper 20. The resultant cold air meets the cold air flowing out from the vegetables compartment, and returns to the cooler 17 via the ventilation return passage 19 (a first ventilation return passage) as shown by the arrow marked F (see FIG. 5). In this way, the inside of the temperature switching compartment 3 is cooled.

As described before, the temperature switching compartment 3 is so configured as to permit the user to switch the internal temperature thereof. For example, the user is permitted to select one from the following temperature zones: freezing (−15° C.), partial (−8° C.), chilled (0° C.), refrigeration (3° C.), and vegetable (8° C.). This enables the user to keep the storage material in frozen or cold storage at a desired temperature. Switching of the internal temperature can be performed by varying the opening volume of the temperature switching compartment discharge damper 13. When switching from the internal temperature for freezing to the internal temperature for refrigeration is performed, for example, the heater 15 may be energized to increase the temperature. This permits to rapidly switch the internal temperature to the desired one.

Further, the internal temperature of the temperature switching compartment 3 can be switched by energizing the heater 15 from the low temperature side at which the storage material is kept in frozen or cold storage to the high temperature side at which temporary heat insulation of cooked food, cooking by keeping the temperature high without use of the heat, or the like are performed. Since a growth temperature of most food poisoning bacteria is 30° C. to 45° C., the internal temperature on the high temperature side may be set to 50° C. or higher by taking into consideration tolerances on the heater capacity, a temperature distribution in the temperature switching compartment 3, and the like. By doing so, it is possible to prevent the growth of miscellaneous germs. Further, since a heat resistant temperature of commonly used resin parts for use in refrigerators is 80° C., by setting the internal temperature of the high temperature side to 80° C. or lower, it is possible to produce a refrigerator at low cost.

In order to destroy food poisoning bacteria, for example, for enterohemorrhagic *Escherichia coli* (*Escherichia coli* 0157), it is necessary to perform heating at 75° C. for one minute. Therefore, it is more preferable to set the internal temperature on the high temperature side to 75° C. to 80° C.

The following is a test result regarding sterilization of food poisoning bacteria performed at a temperature of 55° C. In an initial state, the test samples contained *Escherichia coli* $2.4\times10^3$ CFU/mL, *staphylococcus aureus* $2.0\times10^3$ CFU/mL, *salmonella* $2.1\times10^3$ CFU/mL, *Vibrio parahaemolyticus* $1.5\times10^3$ CFU/mL, and *cereus* $4.0\times10^3$ CFU/mL. The test samples were each heated so that the temperatures thereof were increased from 3° C. to 55° C. in 40 minutes, then kept at 55° C. for 3.5 hours, and then cooled so that the temperatures thereof were decreased from 55° C. to 3° C. in 80 minutes. Then, the colony count of each bacterium was re-examined. The results showed that the colony count of each bacterium was reduced to 10 CFU/mL or lower (not detected). Therefore, even when the set temperature of the temperature switching compartment 3 on the high temperature side is set to 55° C., sufficient sterilization effects can be obtained.

As described before, the heater 15 is made up of a glass tube heater of a thermal radiation type. The heater 15 may be made up of a heat conduction type heater such as an inexpensive sheet-like aluminum evaporation heater. However, this slows a heating speed. As a result, when the temperature switching compartment 3 is set to the high temperature side, it takes a long time to exceed a temperature range 30° C. to 45° C., which is the growth temperature range of the food poisoning bacteria. This reduces the safety in food sanitation. On the other hand, the heater capacity may be increased in order to increase a heating speed. However, there is a limit to the heat resistant temperature (in general, approximately 80° C.) of the peripheral parts to which the heater is attached. Furthermore, in this case, a heat radiation surface is extended to a part near the front of the temperature switching compartment 3. This poses the risk of burn injury to the user.

By contrast, the thermal radiation type glass tube heater offers a fast heating speed and is safe in food sanitation. Furthermore, since a space occupied thereby is small even when the capacity thereof is made large, by disposing the thermal radiation type glass tube heater at a back part of the temperature switching compartment 3 as shown in FIG. 4, the risk of the user having a burn injury is reduced. Therefore, it is more preferable to adopt the thermal radiation type glass tube heater as the heater 15.

The heater 15 can drive at a capacity larger than the capacity which is necessary for maintaining a high internal temperature at which cooked food is kept warm. This permits the temperature switching compartment 3 to be switched quickly to the high temperature side by driving the heater 15 at a large capacity when the temperature switching compartment 3 is switched from the low temperature side to the high temperature side so as to increase the temperature thereof. As a result, it is possible to achieve a highly convenient refrigerator 1. Further, when the temperature switching compartment 3 reaches the internal temperature on the high temperature side, the heater 15 starts to be driven at a lower capacity. This makes it possible to keep the temperature switching compartment 3 at a predetermined temperature.

Figure 7A:
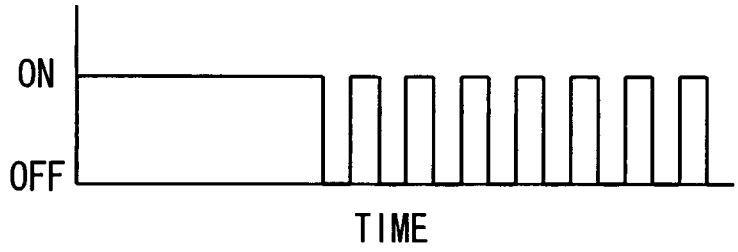
[FIG. 7] Charts showing an example of heater control of the refrigerator according to the first embodiment of the present invention.
Figure 7B:
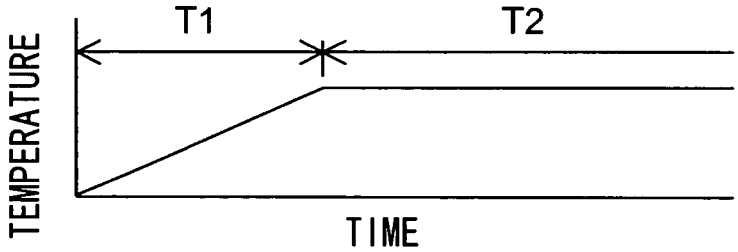

The capacity of the heater 15 can be changed by the duty factor. FIG. 7 shows a control example of the heater 15 whose duty factor is variable. A vertical axis in FIG. 7(*a*) represents an applied voltage according to on/off of the heater 15, and a horizontal axis represents time. A vertical axis in FIG. 7(*b*) represents the internal temperature of the temperature switching compartment 3, and a horizontal axis represents time.

According to these drawings, in an increasing temperature period T1 during which the temperature inside the temperature switching compartment 3 is increased by switching the internal temperature thereof from the low temperature side to the high temperature side, the heater 15 is driven at a duty factor of 100%. When the temperature sensor 16 detects that the internal temperature has reached the set temperature on the high temperature side, it is shifted to a heat insulation period T2 during which the storage material is kept warm. In this period, the heater 15 is turned on/off repeatedly at a predetermined duty factor to keep a temperature on the high temperature side.

For example, when the internal temperature of the temperature switching compartment 3 having an inner volume of approximately 0.023 $m^3$ is increased from 3° C. by using the heater 15 having an electric power consumption of approximately 190 W and a surface area of approximately 10,990 $mm^2$ and setting the duty factor of the heater 15 to 100%, it reaches 80° C. in approximately 30 minutes. Then, by performing intermittent operation at a duty factor of 15% (ON for 15 seconds, OFF for 85 seconds), the temperature switching compartment 3 can be kept at approximately 80° C. Here, used as the blower 14 is a motor provided with an axial fan, and the blower 14 operates with a delivery air volume of approximately 0.4 $m^3$/min.

In this case, in a heat insulation state, the surface temperature of the heater 15 reaches approximately 250° C. at a maximum and is kept at a temperature that is lower than an ignition point temperature (494° C.) of isobutane which is a flammable refrigerant. As a result, in a case where isobutane, which is a flammable refrigerant, is used as a refrigerant sealed in a freezing cycle out of consideration to the environment, there is no risk of an explosion or the like due to the heat generated by the heater 15 even if isobutane leaks out of the cooler 17 or the like. This makes it possible to provide the refrigerator 1 with enhanced safety for the user.

Figure 8A:
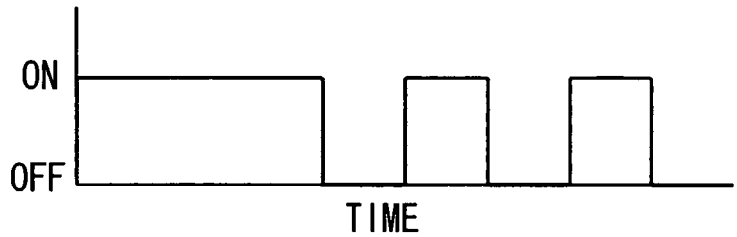
[FIG. 8] Charts showing another example of heater control of the refrigerator according to the first embodiment of the present invention.
Figure 8B:
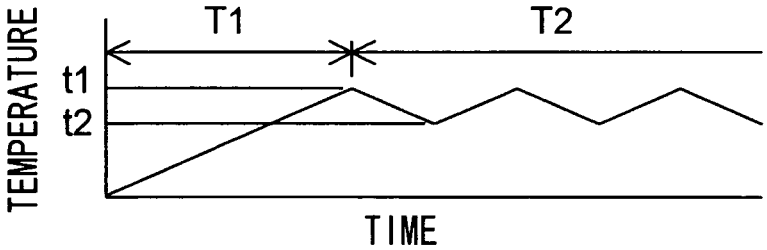

FIG. 8 shows another control example of the heater 15 whose duty factor is variable. A vertical axis in FIG. 8(*a*) represents an applied voltage according to on/off of the heater 15, and a horizontal axis represents time. A vertical axis in FIG. 8(*b*) represents the internal temperature of the temperature switching compartment 3, and a horizontal axis represents time. According to these drawings, when the temperature sensor 16 detects that the internal temperature has reached a predetermined temperature t1, the heater 15 is turned off; when it is detected that the internal temperature has reached a predetermined temperature t2, the heater 15 is turned on. As a result, in the increasing temperature period T1, the duty factor is 100%; in the heat insulation period T2, the duty factor is not constant but is smaller than that in the increasing temperature period T1. Therefore, the capacity of the heater 15 in the increasing temperature period T1 is larger than that in the heat insulation period T2.

According to this embodiment, since there is provided the temperature switching compartment 3 capable of switching the internal temperature between the low temperature side at which the storage material is kept in cold storage and the high temperature side at which cooked food is kept warm, it is possible to provide a highly convenient refrigerator 1 that is capable of keeping cooked food warm and that, by eliminating the need for an additional insulating cabinet, decreases a financial burden and saves a space for it.

Figure 9:
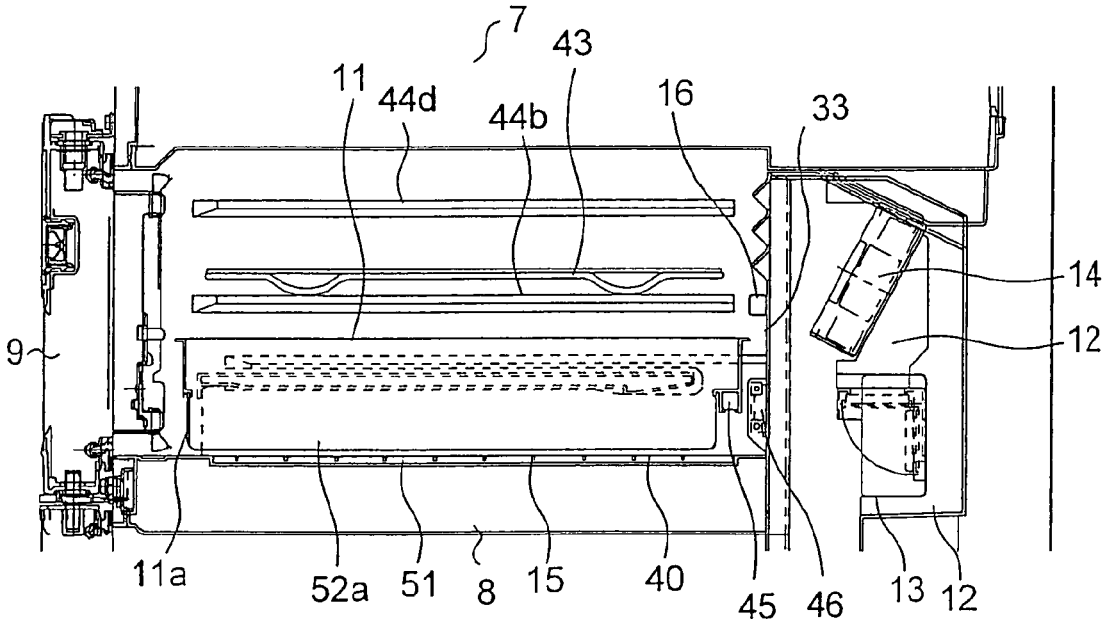
[FIG. 9] A right sectional side view showing a temperature switching compartment of a refrigerator according to a second embodiment of the present invention.
Figure 10:
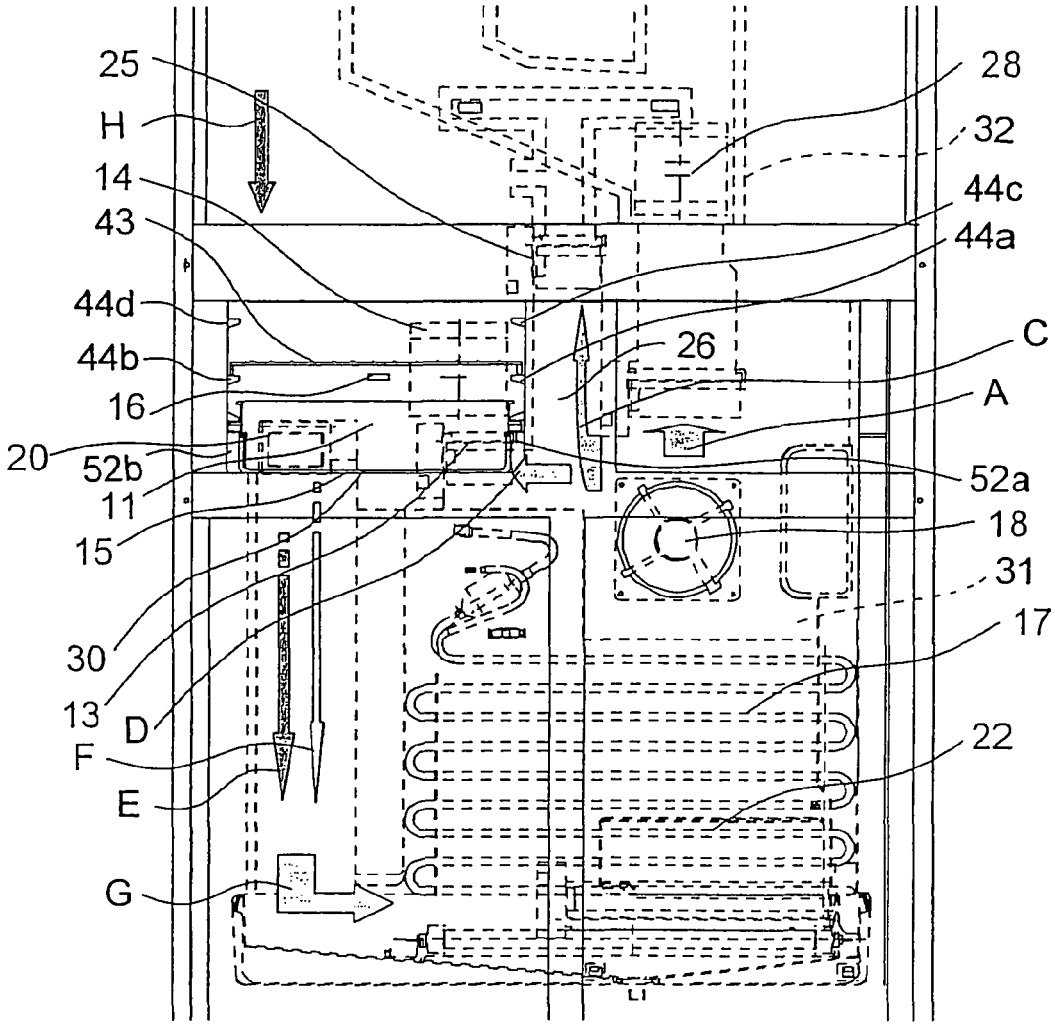
[FIG. 10] A front sectional view of a middle section of the refrigerator according to the second embodiment of the present invention.

Next, FIG. 9 and FIG. 10 are a right sectional side view showing a temperature switching compartment 3 of a refrigerator 1 and a front sectional view of a middle section of a refrigerator 1 according to a second embodiment. For the sake of convenience of description, the same reference numerals are given to those similar to the first embodiment shown in aforementioned FIG. 1 to FIG. 8. A heater 15 fixed to a metal plate 40 is disposed at the bottom part of the temperature switching compartment 3 of the refrigerator 1 of this embodiment.

The heater 15 is controlled by a control section (not shown) provided in the outside of the temperature switching compartment 3. The aforementioned sheet-like aluminum evaporation heater and the thermal radiation type heater can be used as the heater 15. By the driving of the heater 15, the temperature switching compartment 3 is heated from the bottom part, and the heated air moves upward. This makes it possible to make the internal temperature distribution uniform with ease. The heat generated by the heater 15 is transmitted to the metal plate 40 having high heat conductivity, and therefore, the heating efficiency can be improved.

It is more preferable to dispose the heater 15 between the metal plate 40 fixed to the bottom part of the temperature switching compartment 3 and a partition wall 8. This helps eliminate the possibility that the user gets burned by touching the heater 15 and attain a more attractive appearance by covering the heater 15. Further, it is more preferable to provide an interspace 51 between the heater 15 and the partition wall 8. Air thermal insulation formed by the interspace 51 between the heater 15 and the partition wall 8 suppresses a rise in the temperature of the partition wall 8, whereby deformation of the partition wall 8 can be prevented, and thermal influence on a vegetables compartment 5 across the partition wall 8 can be suppressed.

The heater 15 does not necessarily have to be attached directly to the metal plate 40. It is necessary simply to provide the metal plate 40 around the heater 15. Even with this structure, heating efficiency can be improved sufficiently. Further, a plurality of metal plates may be provided. Radiation heat may be blocked by providing another metal plate under the heater 15 so as to secure a space between this metal plate and the partition wall 8.

Further, auxiliary heaters may be provided at the side, rear, and top surfaces of the temperature switching compartment 3. This allows to change a heating speed and to make uniform a temperature distribution in the temperature switching compartment 3 on the high temperature side.

A storage case 11 disposed in the temperature switching compartment 3 is slidably and detachably supported with rails 52*a* and 52*b* which are provided on the right and left side inner walls of the temperature switching compartment 3. The storage case 11 has a bottom part 11*a* made of metal, the bottom part 11*a* including a bottom surface, and has an upper part made of resin. With this structure, heating from the bottom surface of the storage case 11 can be effectively performed by the heater 15 provided on the lower side of the storage case 11. Further, the bottom surface of the storage case 11 can be prevented from being deformed by the weight of food accommodated in the storage case 11 during heating by the heater 15. Further, even if a cooking utensil (a frying pan, a pan, or the like) just removed from the heat is placed directly on the storage case 11, thermal deformation thereof can be prevented.

If the storage case 11 is entirely made of resin, the cubic volume of the storage case 11 varies greatly depending on whether the temperature switching compartment 3 is set to the low temperature side or to the high temperature side. This results in looseness between the storage case 11 and the rails 52*a* and 52*b* during a low temperature. On the other hand, during a high temperature, there is no clearance between the storage case 11 and the rails 52*a* and 52*b*, making it difficult to pull out the storage case 11. The storage case 11 simply has to have at least a bottom surface made of metal. For example, the storage case 11 may be entirely made of metal.

A magnet 45 is provided at the rear of the storage case 11. At a rear plate 33 of the temperature switching compartment 3, a reed switch 46 is provided so as to face the magnet 45. In a state where the storage case 11 is placed in the temperature switching compartment 3, the magnet 45 and the reed switch 46 make contact with each other. In a state where the storage case 11 is pulled out halfway or pulled out completely, the magnet 45 and the reed switch 46 are separated from each other. The reed switch 46 can detect whether or not the storage case 11 is placed in the temperature switching compartment 3 by detecting a contact state between the reed switch 46 and the magnet 45. Therefore, the reed switch 46 and the magnet 45 together form a detector for detecting how the storage case 11 is placed.

In the case where the storage case 11 is not placed in the temperature switching compartment 3, it is preferable to perform control so that the heater 15 is not energized. By doing so, when the storage case 11 is removed for cleaning or the like, it is possible to avoid the risk of the user having a burn injury by accidentally touching the metal plate 40.

It is more preferable to dispose the storage case 11 so that the bottom surface of the storage case 11 makes contact with the upper surface of the metal plate 40. By doing so, the heat generated by the heater 15 is efficiently transmitted to food accommodated in the storage case 11 via the metal plate 40 and the metal of the bottom surface of the storage case 11. Furthermore, by doing so, the storage case 11 can be supported not only by the rails 52*a* and 52*b* but also by the bottom surface, and therefore, deformation of the storage case 11 due to the weight of food can be prevented.

Further, it is preferable that a clearance between the storage case 11 and the side surface and the bottom surface of the temperature switching compartment 3 is 7 mm or less. With this structure, the test finger specified in the Electrical Appliance and Material Safety Law (Japan), for example, is only allowed to be inserted thereinto to a depth of as little as approximately 10 mm. This makes it difficult for the user to touch the metal plate 40, and accordingly improves the safety of the refrigerator 1.

A metal net shelf 43 is provided on the upper side of storage case 11 in the temperature switching compartment 3. The net shelf 43 is supported by rails 44*a* and 44*b* for the net shelf or rails 44*c* and 44*d* for the net shelf, each of which is provided on the left or right side inner wall of the temperature switching compartment 3. The rails 44*c* and 44*d* for the net shelf are disposed at the upper part in the temperature switching compartment 3, and the rails 44*a* and 44*b* for the net shelf are disposed between the rails 44*c* and 44*d* for the net shelf and the storage case 11. The net shelf 43 is slidably and detachably supported by the rails 44*a* to 44*d* for the net shelf.

The food storage efficiency is improved by providing the net shelf 43. Further, as a result of the net shelf 43 having a net structure, the air inside the temperature switching compartment 3 produces convection with ease both at a low temperature and a high temperature, making it possible to keep the internal temperature uniform. Furthermore, by making the net shelf 43 of metal, it is possible to prevent it from being deformed due to the weight of food when food is placed thereon at a high temperature.

Figure 11:
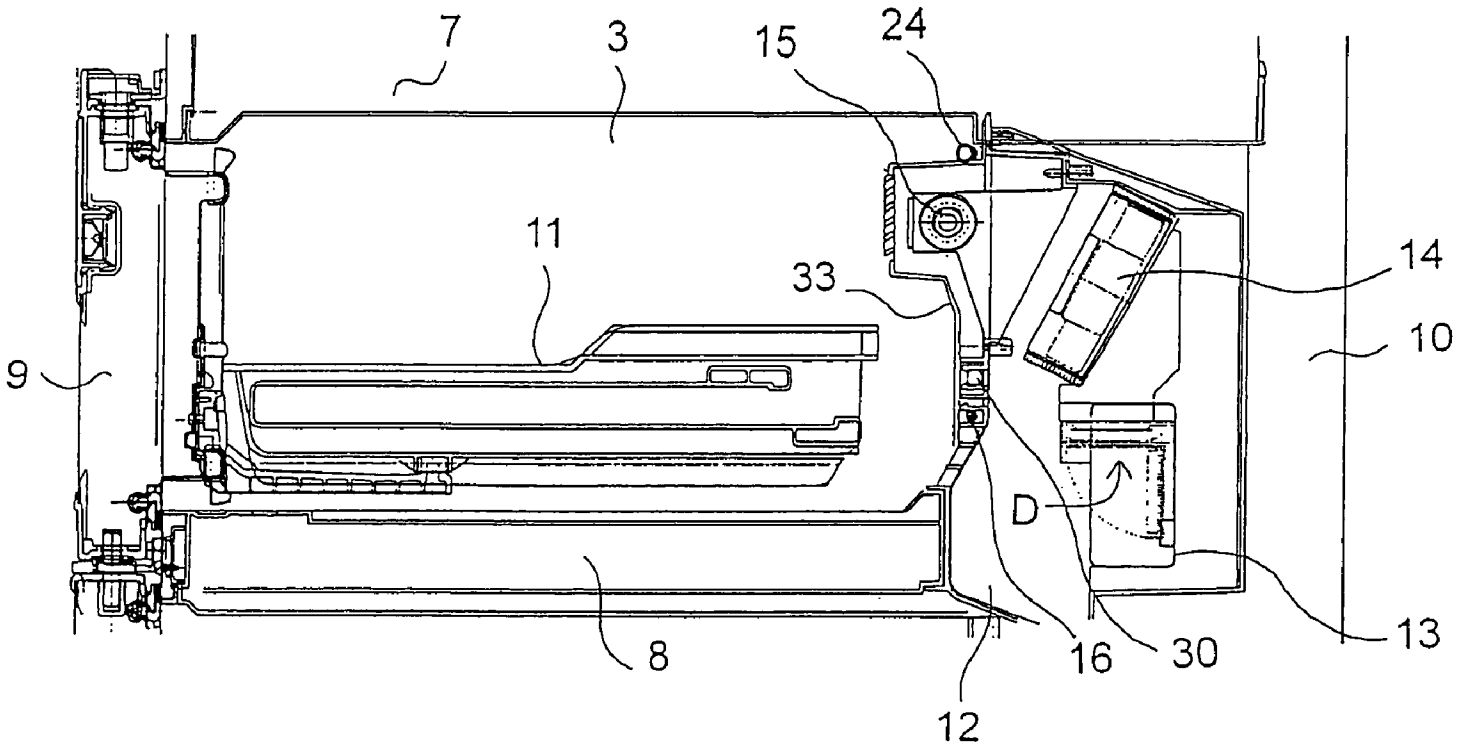
[FIG. 11] A right sectional side view showing a temperature switching compartment of a refrigerator according to a third embodiment of the present invention.
Figure 12:
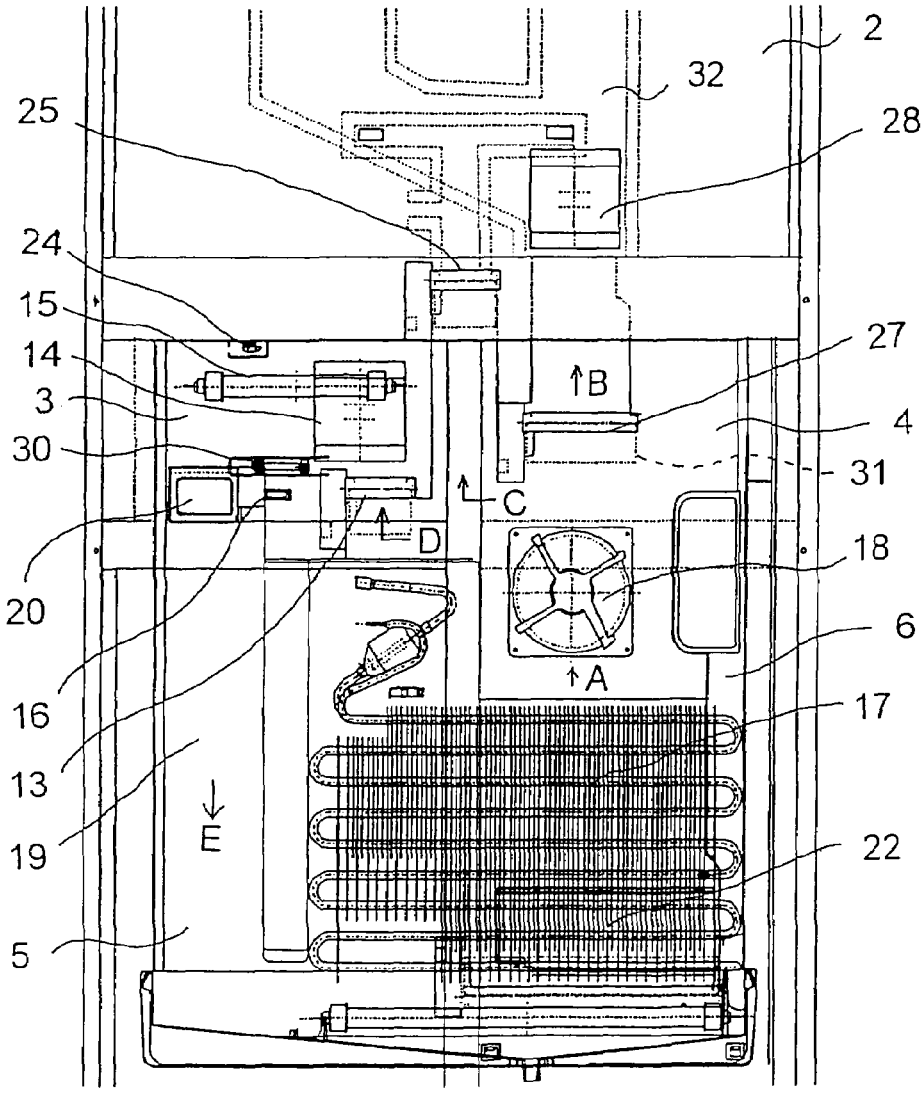
[FIG. 12] A front sectional view of a middle section of the refrigerator according to the third embodiment of the present invention.

Next, FIG. 11 and FIG. 12 are a right sectional side view showing a temperature switching compartment 3 of a refrigerator 1 and a front sectional view of a middle section of the refrigerator 1 according to a third embodiment. For the sake of convenience of description, the same reference numerals are given to those similar to the first embodiment shown in aforementioned FIG. 1 to FIG. 8. The rear of a temperature switching compartment 3 of a refrigerator 1 of this embodiment is covered with a rear plate 33, and a heater 15 made up of a glass tube heater of a thermal radiation type is provided in the upper rear of the rear plate 33.

A temperature sensor 16 (first detector) is provided in the lower rear of the rear plate 33. The temperature sensor 16 detects the temperature inside the temperature switching compartment 3, and sends a detection signal to a control section (not shown). This makes the control section control the heater 15, a temperature switching compartment discharge damper 13, and a blower 14 based on the detection result of the temperature sensor 16 to maintain in the temperature inside the temperature switching compartment 3 at a set temperature.

Further, a temperature sensor 24 (second detector) is provided on the upper side next to the heater 15. The temperature sensor 24 is in close contact with an upper surface of the rear plate 33 that is provided in such a way as to enclose the heater 15. With this structure, the temperature sensor 24 detects the temperature in the neighborhood of a part above the heater 15, where the temperature is most easily increased due to an upward movement of the air heated by the radiation heat of the heater 15.

A thermal fuse 30 is provided on the upper side of the temperature sensor 16. When reaching a predetermined high temperature, the thermal fuse 30 interrupts energization of the heater 15.

Figure 13:
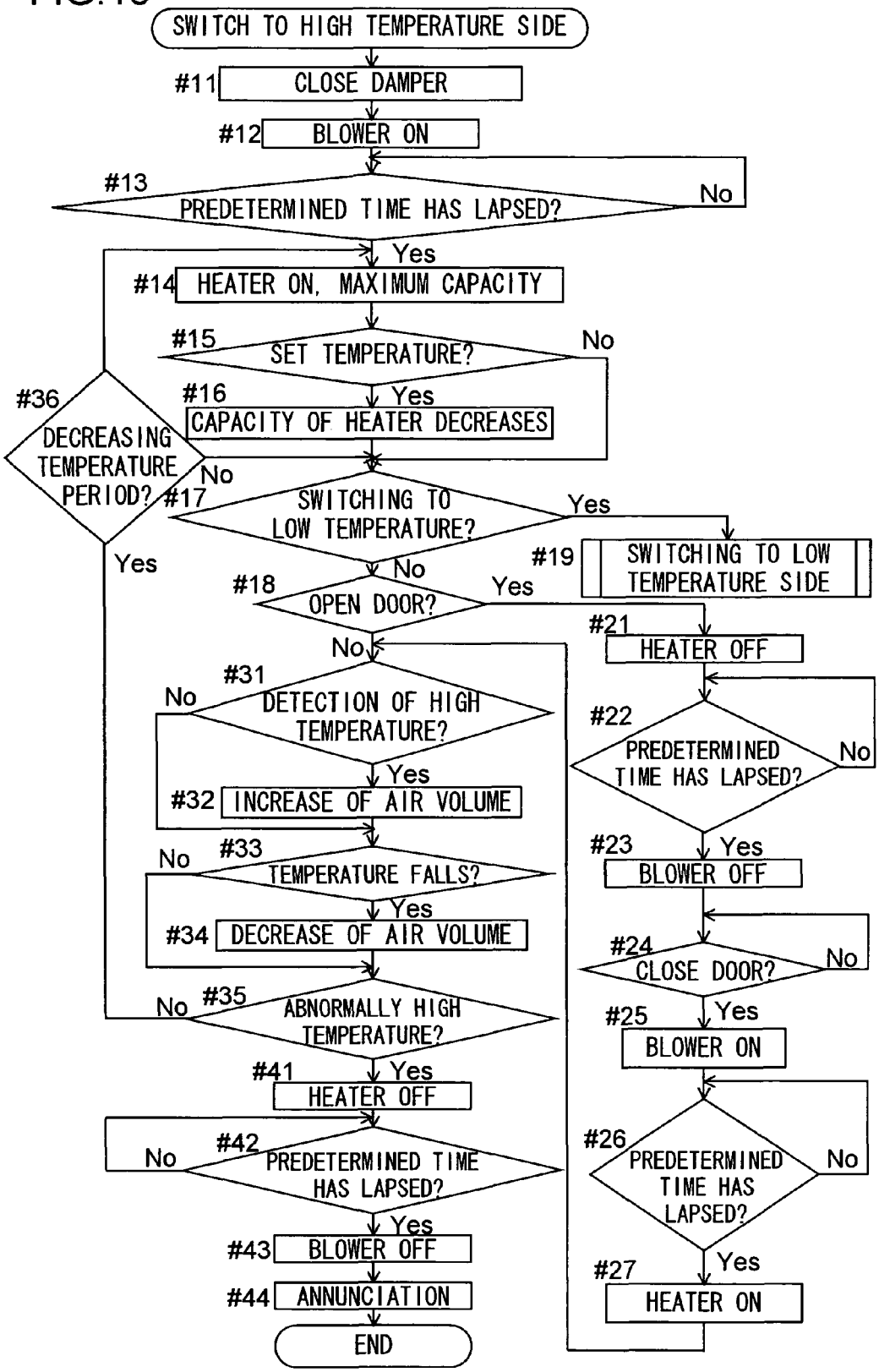
[FIG. 13] A flow chart showing a switching operation on a high temperature side of the temperature switching compartment of the refrigerator according to the third embodiment of the present invention.
Figure 14:
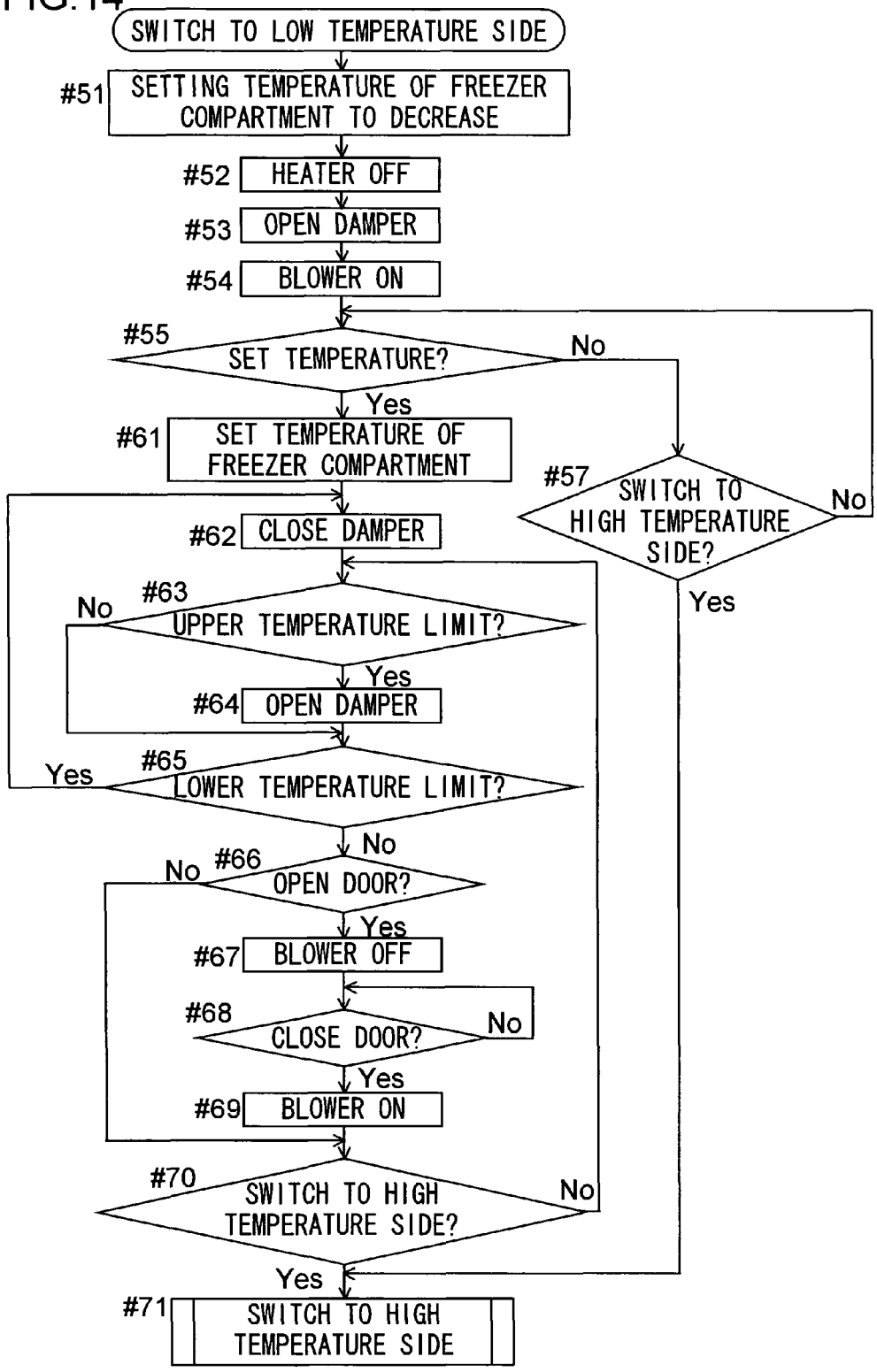
[FIG. 14] A flow chart showing a switching operation on a low temperature side of the temperature switching compartment of the refrigerator according to the third embodiment of the present invention.

FIG. 13 and FIG. 14 are flow charts showing control operations on a high temperature side and a low temperature side of the temperature switching compartment 3, respectively. The heater 15 is controlled by changing a duty factor as shown in aforementioned FIG. 7(*a*) and FIG. 7(*b*). The duty factor may be changed as shown in aforementioned FIG. 8(*a*) and FIG. 8(*b*).

When the temperature switching compartment 3 is switched from the low temperature side to the high temperature side, the temperature switching compartment discharge damper 13 and a temperature switching compartment return damper 20 are closed in step #11 in FIG. 13. The blower 14 is driven in step #12. The procedure goes into standby in step #13 until a predetermined time elapses, and, in step #14, the heater 15 is energized and driven at a duty factor of 100%. Since the blower 14 starts to be driven a predetermined time before the heater 15 is energized, the heater 15 is energized in a state where circulating airflow is generated in the temperature switching compartment 3. This helps prevent overheating around the heater 15.

In step #15, it is determined, based on the detection of the temperature sensor 16, whether or not the inside of the temperature switching compartment 3 reaches the set temperature on the high temperature side. In the increasing temperature period T1 during which the inside of the temperature switching compartment 3 does not reach the set temperature, the procedure goes to step #17. When the inside of the temperature switching compartment 3 reaches the set temperature, the duty factor of the heater 15 is changed in step #16 so as to lower the capacity of the heater 15. As a result, it is shifted to the heat insulation period T2 (see FIG. 7(*b*)), and the procedure goes to step #17.

In step #17, it is determined whether or not switching operation to the low temperature side is performed. When switching operation to the low temperature side is performed, a flow chart of FIG. 14 is called in step #19. When switching operation to the low temperature side is not performed, the procedure goes to step #18, and it is determined whether or not a door 9 is opened.

When the door 9 is not opened, the procedure goes to step #31. When the door 9 is opened, the procedure goes to step #21. In step #21, energization of the heater 15 is stopped. This makes it possible to prevent the user from getting burned by touching the high-temperature heater 15. Therefore, the safety can be improved. In step #22, the procedure goes into standby until a predetermined time elapses, and the blower 14 stops in step #22. Since the blower 14 is stopped being driven a predetermined time after the heater 15 is stopped, the heater 15 is cooled by the airflow produced by the blower 14. This helps prevent the user from getting burned, and prevent overheating around the heater 15. Thus, the safety can be further improved.

The procedure goes into standby until the door 9 closes in step #24. When the door 9 closes, the blower 14 starts to be driven in steps #25 to #27 a predetermined time before the heater 15 is energized. The duty factor of the heater 15 thus energized is the same as the duty factor thereof observed when it was stopped. Then, the procedure goes to step #31.

In step #31, it is determined whether or not the detection temperatures of the temperature sensors 16 and 24 become equal to their respective predetermined high temperatures. The predetermined temperatures are each set to a temperature that is lower than an abnormally high temperature at which smoking, ignition, deformation or the like could occur around the heater 15. In the case where the temperatures do not reach the predetermined temperatures, the procedure goes to step #33. In the case where the temperatures reach the predetermined temperatures, the rotating speed of the blower 14 is increased to increase the air volume in step #32, and the procedure goes to step #33. By doing so, the temperature switching compartment 3 is cooled by the increase of the air volume before it becomes an abnormally high temperature and is prevented from being overheated. Therefore, the safety can be further improved, and the convenience can also be improved by reducing the occurrence of abnormal stop or the like.

The air volume of the blower 14 may be increased when a difference between the temperatures of the temperature sensors 16 and 24 becomes larger than a predetermined temperature difference before these sensors reach their respective predetermined temperatures. By doing so, in the case where a temperature distribution in the temperature switching compartment 3 becomes large due to the blockage or the like caused by the storage material located near the heater 15, it is possible to make the temperature distribution uniform. This makes it possible to prevent the temperature near the heater 15 from becoming abnormally high.

In step #33, it is determined whether or not the detection temperatures of the temperature sensors 16 and 24 are lowered by a predetermined level after the air volume of the blower 14 is increased in step #32. In the case where the detection temperatures of the temperature sensors 16 and 24 are not lowered by a predetermined level, the procedure goes to step #35. In the case where the detection temperatures of the temperature sensors 16 and 24 are lowered by a predetermined level, the rotating speed of the blower 14 is reset in step #34, so that the air volume is decreased, and the procedure goes to step #35.

In step #35, it is determined whether or not the detection temperatures of the temperature sensors 16 and 24 reach an abnormally high temperature at which smoking, ignition, and deformation or the like could occur around the heater 15. In the case where the temperatures reach the abnormally high temperature, the heater stops in step #41. In step #42, the procedure goes into standby until a predetermined time elapses, and the blower 14 stops in step #43. This makes it possible to prevent overheating around the heater 15 by cooling the vicinity of the heater 15. Then, the abnormal state is annunciated in step #44 and the flow chart is ended.

Since the heater 15 is stopped when the temperature sensors 16 and 24 detect an abnormally high temperature, a refrigerator with enhanced safety can be obtained. Furthermore, since the heater 15 is also stopped by the detection of the temperature sensor 24, it is possible to prevent overheating around the heater 15, which cannot be detected by the temperature sensor 16 that detects an average temperature of the temperature switching compartment 3.

In this way, smoking, ignition, deformation, or the like, of the heater 15 and around the heater 15 can be prevented. Therefore, even when a large capacity heater 15 is used, it is possible to realize a refrigerator 1 with enhanced safety. In the case where an abnormally high temperature is not detected due to, for example, the malfunction of the temperature sensors 16 and 24, the thermal fuse 30 is cut so that the heater 15 is stopped.

When the abnormally high temperature is not detected in step #35, the procedure goes to step #36. In step #36, determination is made as to whether or not it is in the increasing temperature period T1. In the case where it is in the increasing temperature period T1, the procedure goes back to step #15, and steps #15 to #35 are performed repeatedly. Further, in the case where it is in the heat insulation period T2, the procedure goes back to step #17, and steps #17 to #35 are performed repeatedly.

When the internal temperature of the temperature switching compartment 3 is switched from the high temperature side to the low temperature side, a flow chart of FIG. 14 is called. In step #51, the set temperature of the freezer compartment 6 is lowered and the freezer compartment 6 is set to an overcooled state. When the internal temperature of the temperature switching compartment 3 is switched from the high temperature side to the low temperature side, the temperature of the cold air flown out from the temperature switching compartment 3 and subjected to heat exchange in the cooler 17 is increased.

As a result, even when the average temperature of the freezer compartment 6 is equal to the set temperature, the temperature around the inflow opening through which the cold air is flown into the freezer compartment 6 becomes locally high. For this reason, the freezer compartment 6 is overcooled so as to rapidly lower the temperature of the cold air flown into the freezer compartment 6. This makes it possible to prevent a locally high temperature of the freezer compartment 6, and accordingly to maintain freshness of the storage material. The set temperatures of the refrigeration compartment 2, the chilled compartment 23, and the vegetables compartment 5 may be lowered.

The heater 15 is stopped in step #52. The temperature switching compartment discharge damper 13 and the temperature switching compartment return damper 20 are opened in step #53. The blower 14 is driven in step #54. In step #55, based on the detection of the temperature sensor 16, it is determined whether or not the internal temperature of the temperature switching compartment 3 reaches the set temperature.

In the case where the internal temperature of the temperature switching compartment 3 does not reach the set temperature, it is in a decreasing temperature period during which the temperature is decreased from the high temperature side to the low temperature side, and the procedure goes to step #57. In step #57, it is determined whether or not switching operation to the high temperature side is performed. In the case where the switching operation to the high temperature side is performed, the procedure goes to step #71, and the aforementioned flow chart of FIG. 13 is called. In the case where the switching operation to the high temperature side is not performed, the procedure goes back to step #55, and steps #55 and #57 are performed repeatedly.

In the case where determination is made in step #55 that the internal temperature of the temperature switching compartment 3 reaches the set temperature, the procedure goes to step #61. In step #61, the set temperature of the freezer compartment 6 is reset. In step #62, the temperature switching compartment discharge damper 13 and the temperature switching compartment return damper 20 are closed. Although the temperature switching compartment return damper 20 does not have to be closed, it is preferable to close it for preventing the cold air from flowing out therefrom. This makes the cold air circulate in the temperature switching compartment 3, and makes the internal temperature uniform.

In step #63, based on the detection of the temperature sensor 16, it is determined whether or not the internal temperature of the temperature switching compartment 3 reaches the upper limit of the set temperature range. In the case where the temperature switching compartment 3 does not reach the upper limit, the procedure goes to step #65. In the case where the temperature switching compartment 3 reaches the upper limit, the temperature switching compartment discharge damper 13 and the temperature switching compartment return damper 20 are opened in step #64, and the cold air is taken from the cold air passage 31 to the temperature switching compartment 3.

In step #65, based on the detection of the temperature sensor 16, it is determined whether or not the internal temperature of the temperature switching compartment 3 reaches the lower limit of the set temperature range. In the case where the temperature switching compartment 3 does not reach the lower limit, the procedure goes to step #66. In the case where the temperature switching compartment 3 reaches the lower limit, the procedure goes back to step #62, and the temperature switching compartment discharge damper 13 and the temperature switching compartment return damper 20 are closed.

In step #66, it is determined whether or not the door 9 is opened. In the case where the door 9 is not opened, the procedure goes to step #70. In the case where the door 9 is opened, the blower 14 is stopped in step #67. This prevents the cold air from flowing out therefrom. The procedure goes into standby until the door 9 is closed in step #68. When the door 9 is closed, the blower 14 is driven in step #69. Note that, in the decreasing temperature period constituted by steps #55 and #57, the blower 14 is not stopped even when the door 9 is opened. This makes it possible to rapidly lower the temperature of the temperature switching compartment 3 by releasing a high temperature air when the door 9 is opened.

In step #70, it is determined whether or not switching operation to the high temperature side is performed. In the case where the switching operation to the high temperature side is performed, the procedure goes to step #71, and the aforementioned flow chart of FIG. 9 is called. In the case where the switching operation to the high temperature side is not performed, the procedure goes back to step #63, and steps #63 to #70 are performed repeatedly.

In the first to the third embodiments, a damper may be provided at an outflow opening of the vegetables compartment 5. With this structure, when the temperature switching compartment 3 is switched from the high temperature side to the low temperature side, it is possible to prevent the hot air from the temperature switching compartment 3 from flowing back to the vegetables compartment 5 by closing the damper. Furthermore, in the case where the blower 18 is stopped when the temperature switching compartment 3 is switched from the high temperature side to the low temperature side, the freezer compartment damper 22 is closed. This makes it possible to prevent the hot air from flowing back to the freezer compartment 6 from the freezer compartment damper 22 by the driving of the blower 14.

INDUSTRIAL APPLICABILITY

The present invention can be applied to a refrigerator including a temperature switching compartment that allows the user to switch the internal temperature thereof.

The invention claimed is:

1. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

a first detector for detecting the internal temperature of said temperature switching compartment; and a second detector provided next to said heater for detecting temperature in a neighborhood of said heater, wherein the capacity of said heater is changed based on the detection result of said first detector; and said heater stops when a detection temperature of said second detector is larger than a predetermined temperature.

2. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

a blower for circulating air in said temperature switching compartment, wherein said blower starts to be driven a predetermined time before said heater is energized, and is stopped being driven a predetermined time after the said heater is stopped.

3. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

a first detector for detecting the internal temperature of said temperature switching compartment; and a blower for circulating air in said temperature switching compartment, wherein the capacity of said heater is changed based on the detection result of said first detector; and air volume of said blower increases when a detection temperature of said first detector exceeds a predetermined temperature.

4. The refrigerator according to claim 3, further comprising:

a second detector provided next to said heater for detecting temperature in a neighborhood of said heater, wherein the air volume of said blower increases when a detection temperature of said second detector exceeds a predetermined temperature.

5. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

a first detector for detecting the internal temperature of said temperature switching compartment;

a second detector provided next to said heater for detecting temperature in a neighborhood of said heater; and a blower for circulating air in said temperature switching compartment, wherein the capacity of said heater is changed based on the detection result of said first detector; and air volume of said blower increases when a difference between detection temperatures of said first and second detectors exceeds a predetermined temperature.

6. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

an open/close detector for detecting opening and closing of a door of said temperature switching compartment, wherein said heater stops when said door of said temperature switching compartment opens in the period during which temperature increases or the period during which temperature is kept at the high temperature side; and said heater is energized when said door closes.

7. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

an open/close detector for detecting opening and closing of a door of said temperature switching compartment; and a blower for introducing cold air into said temperature switching compartment, wherein said blower is driven in a period during which temperature of said temperature switching compartment is decreased from the high temperature side to the low temperature side; and said blower is kept driven when said door opens.

8. A refrigerator including at least one storage compartment for keeping a storage material in cold storage, comprising:

a temperature switching compartment that can switch an internal temperature thereof, by cooling with a cooler and by heating with a heater, to a low temperature side at which the storage material is kept in cold storage and to a high temperature side at which cooked food is kept warm, wherein a capacity of said heater in a period during which temperature increases from the low temperature side to the high temperature side is larger than a capacity of said heater in a period during which temperature is kept at the high temperature side;

a freezer compartment for keeping the storage material in frozen storage by cooling with said cooler, wherein in a period during which temperature of said temperature switching compartment is decreased from the high temperature side to the low temperature side, air flowing out from said freezer compartment and said temperature switching compartment is introduced to said cooler; cooled air is delivered by being divided into said freezer compartment and said temperature switching compartment; and a set temperature of said freezer compartment is lowered to produce an overcooled state.

* * * * *